US005744743A

United States Patent [19]

De Poli et al.

[11] Patent Number: 5,744,743

[45] Date of Patent: Apr. 28, 1998

[54] PEDAL RESONANCE EFFECT SIMULATION DEVICE FOR DIGITAL PIANOS

[75] Inventors: Giovanni De Poli, Padua; Francesco Campetella, Pesaro; Giampaolo Borin, Schio, all of Italy

[73] Assignee: Generalmusic S.P.A., Giovanni in Mariqnano, Italy

[21] Appl. No.: 618,379

[22] Filed: Mar. 19, 1996

[30] Foreign Application Priority Data

Apr. 28, 1995 [IT] Italy ..... B095A0192

[51] Int. Cl.[6] ..... G10H 1/02; G10H 7/00

[52] U.S. Cl. ..... 84/630; 84/661; 84/746

[58] Field of Search ..... 84/630, 658–661, 84/701, 746

[56] References Cited

U.S. PATENT DOCUMENTS 4,909,119 3/1990 Morokuma .
4,909,121 3/1990 Usa et al. .
5,198,604 3/1993 Higashi et al. ..... 84/660 X
5,304,734 4/1994 Kunimoto ..... 84/661
5,352,849 10/1994 Kobayashi ..... 84/630 X
5,422,431 6/1995 Ichiki .
5,468,906 11/1995 Colvin, Sr. et al. ..... 84/660 X
5,498,834 3/1996 Inagaki et al. .

*Primary Examiner*—William M. Shoop, Jr.
*Assistant Examiner*—Jeffrey W. Donels
*Attorney, Agent, or Firm*—Finnegan, Henderson, Farabow, Garrett & Dunner, L.L.P.

[57] ABSTRACT

The present invention relates to a pedal resonance effect simulation device for digital pianos consisting of a resonance effect circuit for the simulation of the resonance effects in the strings of a traditional mechanical piano, coupled with a reference model which varies the resonance contributions of the various strings, which are equivalent to those of a mechanical piano, by using delay lines with a method which considers the position of the resonance pedal pressed by the performer upon reproduction.

21 Claims, 2 Drawing Sheets

PEDAL RESONANCE EFFECT SIMULATION DEVICE FOR DIGITAL PIANOS

BACKGROUND OF THE INVENTION

The present invention relates to a pedal resonance effect simulation device for digital pianos comprising of sound generation means, a resonance pedal which is connected to this sound generation means, control means, which control said sound generation means and said resonance pedal and which are provided with own memories, as well as melody reproduction means coupled with said sound generation means, with said resonance pedal and with said control means.

As we know, in music in general and with electronic instruments in general, the performer often uses the resonance pedal in the same way as when using a traditional mechanical piano to create special effects and given sound durations. In a traditional piano, all this takes place by means of the mechanical characteristics of the strings, influenced by the resonance pedal, which applies its hammer to the strings to dampen or otherwise alter the vibrations provoked by the action of the keyboard activated by the fingers. This is obvious in the piano, as the effect produced is a so called natural effect.

In the case of an electronic digital piano, however, this physical effect has to be reproduced as faithfully as possible by way of simulation.

In accordance with existing technology, the methods of doing this, which take the form of digital circuits, let only simulate the resonance effect of the pedal, with respect to a mechanical piano, by adding together the sound effects of the several strings related to several corresponding keys, to obtain a global result, but without identifying and assigning the partial effect value of each individual string played, as this is currently difficult to achieve.

This standardisation aspect of the resonance effects of the strings therefore implies the lack of quality in the global result and a reproduction which is not identical to that of a traditional piano.

SUMMARY OF THE INVENTION

In this situation, one of the technical problems at the basis of the invention is the substantial solution to these limits, with the creation and setting up of a device that simulates the resonance pedal effect in digital pianos which automatically, and in line with the force with which the player presses the pedal accurately generates the same resonance effect on the strings as that of a traditional piano.

This objective, together with others that will emerge below, is achieved by the simulation device for the effects of the resonance pedal in digital pianos, as described in the following claims.

BRIEF DESCRIPTION OF THE DRAWINGS

Further characteristics and advantages become apparent from the description of an embodiment of a simulation device for the effects of the resonance pedal in digital pianos. This description is here provided, with reference to the drawings, offered solely as examples, and therefore not exhaustive, in which.

DESCRIPTION OF THE PREFERRED EMBODIMENTS

Figure 1:
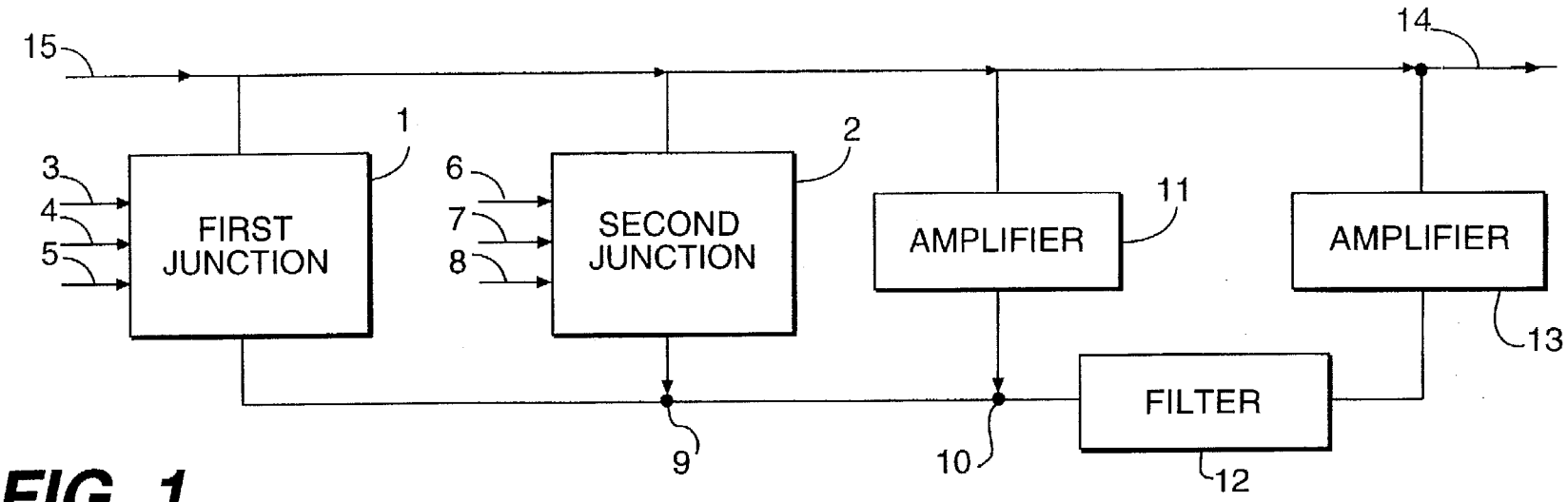
FIG. 1 shows a physical model, in which we can see a first and second joint where signals to the piano strings converge, together with a number of circuits by means of which we obtain a resonance sound as a result of electronic processing, generated by a so-called delay line.

Before referring to FIG. 1, it may be useful to point out that the device in question refers to the analysis of a so-called ideal string, or one that has a precise behaviour in time, normally represented by the following wave equation:

$$K\frac{\delta^2 y}{\delta a^2} = \epsilon\frac{\delta^2 y}{\delta t^2}$$

where x is the horizontal axis and y is the vertical axis, t is the wave propagation time, K is the vibrating string tension and $\epsilon$ is the linear mass of the string. This equation, the work of d'Alembert, gives a specific solution that takes the physical form of the sum of two waves propagated in opposite directions and at a determined speed. In this manner an ideal string is represented, which is propagated by means of a so-called delay line.

Bearing all this in mind, FIG. 1 shows a specific physical model making use of a d'Alembert delay line in which 1 refers to a first joint where the signals for first eighteen strings of a digital piano simulating a classical mechanical piano converge and are taken as having a fixed length. Numeral 2 refers to a second joint where the last ten strings, taken as having a variable length, converge. In joints 1 and 2, the strings are marked with 3, 4 and 5 in the former and 6, 7 and 8 in the latter.

This physical model shows an input signal 15, corresponding to the sound of an ideal piano without the use of the pedal.

Downstream of adder junctions 9 and 10 is performed a low-pass filtration by means of a low pass filter 12.

The cutting frequency for the pass filter 12 is roughly 1 Khz and this filter is of the single pole type.

There are also provided a first amplifier 11, together with a second amplifier 13 and this latter operates as an output signal multiplier for a coefficient that regulates the quantity of effect added to the original input signal 15, thus determining an output 14.

In this model, the coefficient k is identical for all the input strings 3, 4, 5, 6, 7 and 8, but varies in accordance with the way in which the resonance pedal is used.

Figure 2:
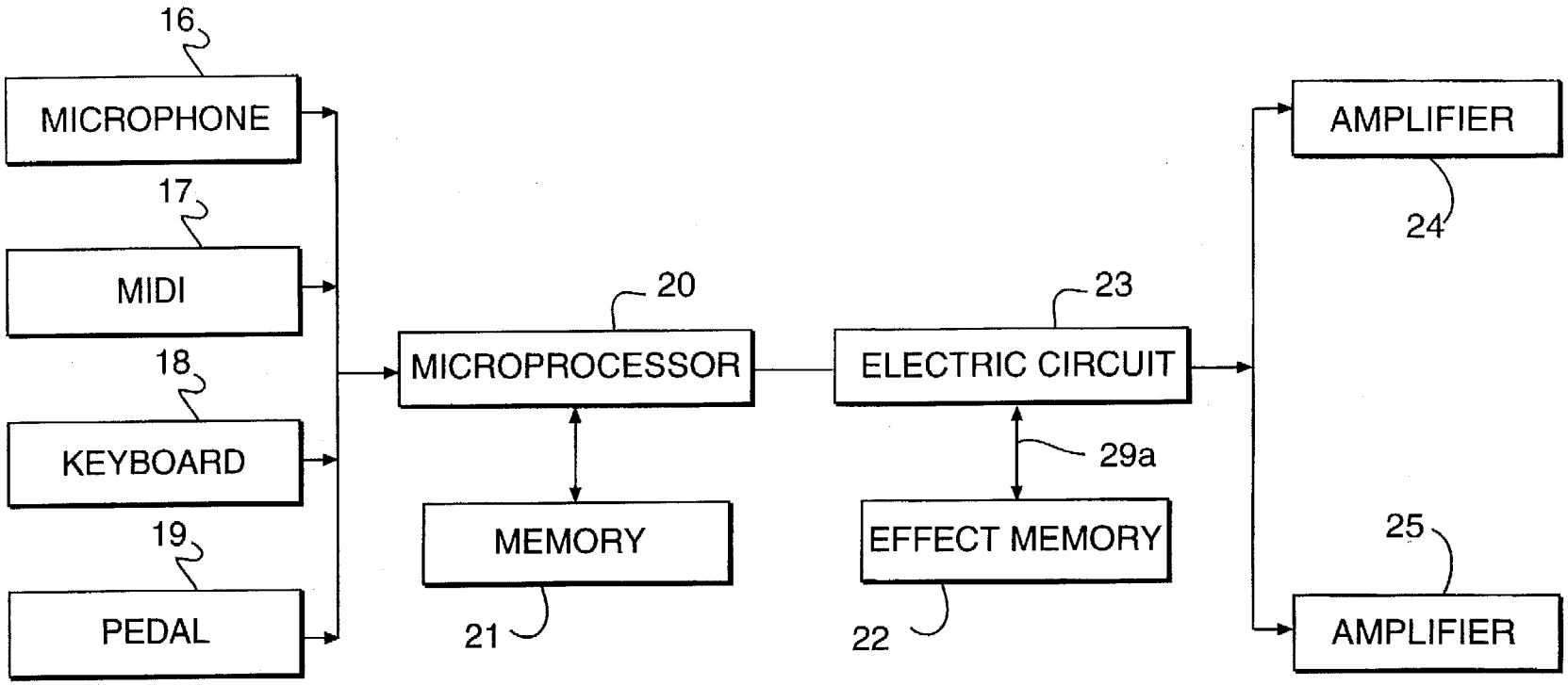
FIG. 2 shows a general block diagram of the circuitry within which the device operates in this invention.

In FIG. 2, elements 16, 17 and 18 are the sound generation means. Element 16 is a microphone from which melodies, or sound compositions are taken, 17 refers to tone or midi converters and 18 to a dynamic keyboard. 19 is a reference pedal that emulates the mechanical one of a classical piano. The sound generation means and the reference pedal converge with their circuits in a control means consisting of a general control microprocessor 20 with memory 21.

Processor 20 interacts in sequence with melody reproduction means used to produce resonance effects consisting of a circuit device 23 with effect memory 22, connected by means of a dual-direction line 29*a*.

Numerals 24 and 25 refer to output amplifiers to produce the melodies required at the volume levels set.

Figure 3:
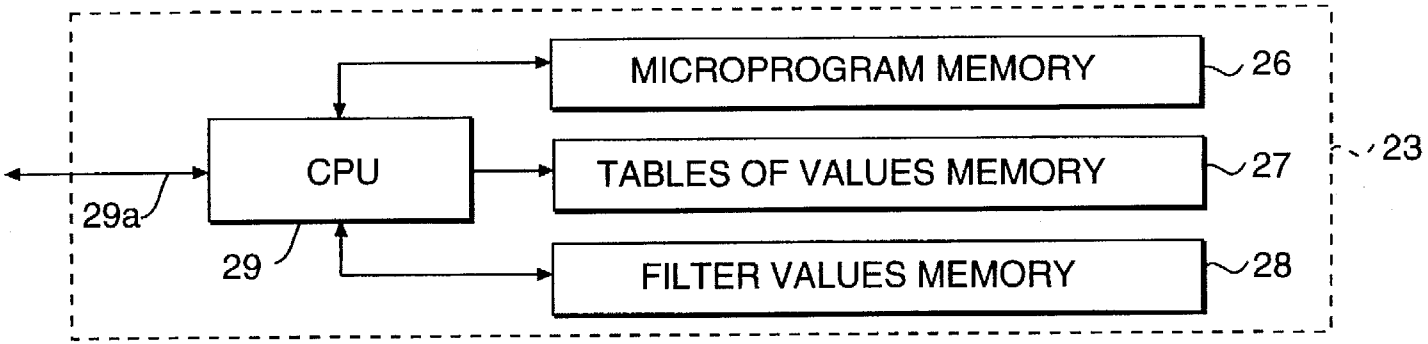
FIG. 3 shows the circuit details of the device according to this invention.

FIG. 3 specifies the contents of device 23, where 29 represents a processor with a RAM memory 26 for processor control, and RAM memories 27 for the memorisation in tables of a coefficient k that stands for the sound loss in the real strings, and a coefficient a standing for the effective sound energy yielded by a string, as well as RAM memories 28 for the memorisation in tables of a filtering coefficient for use by the filter 12 in output from the device. These components operate in accordance with the physical model of the delay line in FIG. 1.

The above is a description of the global structural of the device and its circuit arrangement and there now follows an explanation of the operation.

In brief, device 23 connected to processor 20 simulates the resonance effects of the strings in a classical piano in accordance with the pressure applied by the player on resonance pedal 19, as described in the physical reference model of the delay line, manifested in device 23 which makes it possible to vary the contribution of the resonance supplied by the strings of the simulated mechanical piano, distinguishing each individual string's contribution from all the others.

In the reference circuit of FIG. 1, it is assumed that the coefficient α of sound energy yielded has a value of 0.0625 for all the strings. It was necessary to divide the strings into two junctions, 1 and 2, to avoid effects of interaction between the fixed and variable length strings which produce noise when activated from the piano keyboard.

In the physical model of FIG. 1, the signal output in junctions 1 and 2 is added together and the resulting signal, for the resonance effect alone, crosses low pass filter 12 and is then multiplied in multiplier circuit 13.

FIG. 1 shows a schematization of the processing of the resonance effect of the digital input signal. Table 1 shows the coefficients k of sound loss in the real strings of a classical piano, with reference to junctions 1 and 2. Table 2 refers to the values of k in accordance with the pressure applied on pedal 19.

Device 23, known as RED, has a governing microprogram in memory 26, consisting of a source code of a hundred and forty one instructions, which can obviously vary for further implementations and/or functional variations that can be developed.

Memory 27 contains Table 3, which lists the read and write pointer

TABLE 1

| RAM POINTER ADDRESS | RAM POINTER CONTENT | DESCRIPTION |
|---|---|---|
| 0 | 0.0625 | α SOLE FOR ALL STRINGS |
| 1 | 0.998 | K STRING (1) OF THE FIRST JOINT |
| 2 | 0.998 | K STRING (2) OF THE FIRST JOINT |
| . | . | . |
| . | . | . |
| . | . | . |
| 18 | 0.998 | K STRING (18) OF THE FIRST JOINT |
| 19 | 0 | K STRING (1) OF THE SECOND JOINT |
| 20 | 0 | K STRING (2) OF THE SECOND JOINT |
| . | . | . |
| . | . | . |
| 28 | 0 | K STRING (10) OF THE SECOND JOINT |
| 29 | 0.86 | LOW PASS FILTER COEFFICIENT |
| 30 | 0.73 | C: EFFECT OUTPUT VOLUME |

TABLE 2

| DAMPER | K |
|---|---|
| 0 . . . 15 | 0.625 |
| 16 . . . 31 | 0.854 |
| 32 . . . 47 | 0.897 |
| 48 . . . 63 | 0.927 |
| 64 . . . 79 | 0.949 |

TABLE 2-continued

| DAMPER | K |
|---|---|
| 80 . . . 95 | 0.968 |
| 96 . . . 111 | 0.983 |
| 112 . . . 127 | 0.998 |

TABLE 3

| RAM POINTER ADDRESS | RAM POINTER CONTENT | DESCRIPTION |
|---|---|---|
| 0 | 0 | FIRST STRING READ POINTER 1 |
| 1 | 1 | SECOND STRING READ POINTER 1 |
| 2 | 1348 | STRING WRITE POINTER 1 AND 1st STRING READ POINTER 2 |
| 3 | 1349 | SECOND STRING READ POINTER 2 |
| 4 | 2621 | STRING WRITE POINTER 2 AND 1st STRING READ POINTER 3 |
| . | . | . |
| . | . | . |
| 34 | 15025 | STRING WRITE POINTER 17 AND 1st STRING READ POINTER 18 |
| 35 | 15026 | SECOND STRING READ POINTER 18 |
| 36 | 15530 | STRING WRITE POINTER 18 |
| 37 | 34744 | FIRST STRING READ POINTER 19 |
| 38 | 34745 | SECOND STRING READ POINTER 19 |
| 39 | 36348 | STRING WRITE POINTER 19 |
| 40 | 55562 | FIRST STRING READ POINTER 20 |
| 41 | 55563 | SECOND STRING READ POINTER 20 |
| 42 | 57166 | STRING WRITE POINTER 20 |
| . | . | . |
| . | . | . |
| 64 | 241321 | FIRST STRING READ POINTER 28 |
| 65 | 241322 | SECOND STRING READ POINTER 28 |
| 66 | 242925 | STRING WRITE POINTER 28 |
| 67 | 138834 | READ POINTER Z-' OF FILTER L.P. |
| 68 | 138835 | WRITE POINTER Z-' OF FILTER L.P. |

values of the delay lines shown in FIG. 1, where each delay line uses three pointers, two read and one write; as shown, these are the numerical identification codes of sound waves relating to the single strings.

For the first eighteen strings, a technique is used whereby two delay lines share a pointer and have wavelengths which correspond to notes C1 and F2 in line with the current Anglophone note classification, whose wavelengths are obtained from the number n of the cells forming a delay line, according to the formula n=frequency of sampling/frequency of oscillation of the string, taking a sampling frequency of 44,100 Hertz. For the ten successive strings, reference is made to delay lines with wavelengths corresponding to note A0, whose length is processed by a procedure controlled by processor 20.

More precisely, we can say that the processing of the resonance effects takes place on melodies generated with, for example, MIDI keyboards 17.

In junction 1, the value of coefficient k is linked to the position of pedal 19. In accordance with table 2, when the pedal is in the high position, that is, not pressed, the value assigned to coefficient k obviously has a minimum value, and in this situation junction 1 supplies only the background effect always present in the casing of the piano. The value varies by means of the MIDI "control change dumper pedal" message, that is when pressure is applied to pedal 19, and this provokes a particular resonance effect in proportion to the pressure on the pedal, in terms of volume and decay.

On the other hand the cords of junction 2 are controlled to simulate the true resonance effect. More specifically, the cords relating to junction 2, shown in FIG. 1 by arrows 6, 7 and 8, are controlled in such a way as to simulate the resonance effect in the strings of the piano which, at a determined instant, are freed by the dampers simultaneously, as the keys to which they refer have been pressed.

The strings can have two different states—string active with a coefficient k of 0.998, and string inactive with a coefficient k of 0. In using MIDI signals with a message such as NOTE ON, that is active, the procedure, programmed by means of the reference model in FIG. 1, searches for a free string among the 10 of junction 2. If a free string is found, the wavelength of the single delay line is set in line with the ratio n above, and coefficient k is set to HIGH, equivalent to approx. 1. When a MIDI NOTE OFF message is then received, the procedure searches for the free string previously activated by the corresponding NOTE ON and sets the coefficient to k=0. In fact, coefficient k reaches 0 in successive steps, to avoid an instantaneous closure of the string that would create output noise in the ten strings at junction 2.

At this stage, the handling of the junction 2 strings is independent of the position of resonance pedal 19. But when pedal 19 reaches the "all pressed" position, that is, with a dumper=127 in table 2, the strings which are active when the pedal is pressed fully are kept in this condition until the pedal is released, and will not be freed even when a subsequent NOTE OFF message is received. The free strings when the pedal is fully pressed are activated with the lengths of the delay lines corresponding to the notes subsequent to those of junction 1. This situation remains unaltered until the pedal is released. When the pedal is released, the procedure deactivates all the strings and sets the k for each of these to 0, and if active notes are present, the strings corresponding to each of the notes are activated. The control of the strings in the junctions can however be synthesised in accordance with the following steps: a calculation (processing) is made in the second junction with ten strings, followed by an output calculation (processing) which gives the sum of the two junctions and the filtering with a low pass filter, a multiplication by a reference multiplier and an output sum; finally, an update of all the delay lines in the model of FIG. 1 takes place, by adding to both junctions the input signal 15, then recalculating (reprocessing) the values with which to update the delay lines for the various strings, in successive approximation steps of the resonance effect.

In brief, use is made of the reference model of FIG. 1 by simulating the delay lines of the strings with two junctions, 1 and 2, for the handling of each single string on the basis of the resonance pedal 19 position, when activated at that precise moment.

In this way, the invention achieves its stated objectives. With this device, in fact, the resonance effect in a digital piano imitates perfectly, or at least with a high percentage of superimposition, the behaviour pattern of resonance in a classical piano, by simply exploiting a resonance circuit that identifies the delay lines and a reference model that presents a procedure which activates the resonances at the single strings in accordance with the way in which the resonance pedal is used; this means that the contribution of the resonance supplied by the various strings is made as if the instrument were a true mechanical piano.

Obviously, further variations to the parameters and circuitry are possible with this invention, all of which are within the scope of the presente invention.

What is claimed:

1. A device for simulating in a digital piano the effect of a resonance pedal of a mechanical piano, said device comprising:

signal generation means, including a keyboard, for inputting signals corresponding to sounds of a plurality of simulated piano strings;

a resonance pedal;

generation control means for controlling the signal generation means in accordance with the operation of the resonance pedal;

resonance control means, including an electric circuit connected to said generation control means, for controlling resonance of the generated signals based upon pressure applied to the resonance pedal, said resonance being controlled in accordance with a physical reference model of the behavior of mechanical piano strings defined by wave equation:

$$k(\partial^2 y/\partial x^2)=\epsilon(\partial^2 y/\partial t^2)$$

where x is the horizontal axis, y is the vertical axis, t is wave propagation time, k is vibrating string tension, and $\epsilon$ is linear mass of the string;

said resonance control means distinguishing resonance contributions supplied by each of said simulated strings to simulate the resonance effect of a mechanical piano.

2. A device according to claim 1, wherein said resonance control means comprises:

a microprocessor circuit;

random access memory (RAM) containing instructions to control the microprocessor;

RAM for storing coefficients k corresponding to sound loss of the real strings of a piano, coefficients $\alpha$ corresponding to sound energy effectively yielded by each real string, used by the microprocessor in accordance with the physical reference model; and RAM for storing filtering coefficients for input to an output filter.

3. A device according to claim 2, wherein coefficient k is identical for all the strings and varies in accordance with the operation of the resonance pedal.

4. A device according to claim 1, wherein the physical reference model represents real string delay lines by simulating them with a first junction, in which the simulated strings of fixed length converge, and a second junction in which simulated strings of variable length converge, the outputs of the first and second junctions converging in a node where corresponding signals are added together and are then filtered by a low pass filter and pass an amplifier circuit in sequence to supply the resonance effect on a single signal added to another signal, identifying a signal without piano resonance effect.

5. A device according to claim 4, wherein the first and second junctions contain a first set of eighteen and a second set of ten strings respectively.

6. The device of claim 4 wherein the electric circuit which embodies the physical reference model for the plurality of simulated strings (a) calculates the resonance effect of each of ten simulated strings at the second junction;

(b) calculates, subsequent to the calculation of the resonance effect of the second junction, the sum of the first and second junctions;

(c) filters the sum of the first and second junction with a low pass filter;

(d) multiplies the filtered sum with a reference multiplier;

(e) adds an input signal to the first and second junction for each of the simulated strings in succession; and repeats actions (a) through (e) to update the delay lines.

7. The device of claim 6 wherein the electric circuit which embodies the physical reference model further searches for one of the ten simulated strings at the second junction upon receiving an activation message;

sets the wavelength of a delay line to a value n being a ratio of a sampling frequency to a string oscillation frequency, with coefficient k set to about one;

frees the simulated string searched for upon receipt of the previous activation message, and sets the coefficient k to zero in successive steps to avoid output noise, upon receiving a deactivation message at times when the resonance pedal is not fully operated;

maintains all active simulated strings in the active condition upon receipt of a deactivation message during times when the resonance pedal is fully operated;

activates, until the resonance pedal is released, all deactivated simulated strings at times when the resonance pedal is operated, with delay string lengths corresponding to simulated strings at a junction subsequent to the first junction;

deactivates, when the resonance pedal is released, the simulated strings and setting the coefficient k for the deactivated simulated strings to zero; and activates a simulated string for each of the simulated strings receiving an activation message when the resonance pedal is released.

8. A device for simulating in a digital piano the effect of a resonance pedal of a mechanical piano, said device comprising:

signal generation means, including a keyboard, for inputting signals corresponding to sounds of a plurality of simulated piano strings;

a resonance pedal operable in response to pressure of varying degrees of intensity;

generation control means for controlling the signal generation means in accordance with the operation of the resonance pedal via messages of a note-ON/note-OFF type;

an electric circuit device connected to said signal generation means, to said resonance effect pedal and to the generation control means, for controlling resonance of the generated signals based upon the pressure applied to the resonance pedal, said resonance being controlled in accordance with a physical reference model of the behavior of mechanical piano strings where the resonance contribution is provided by individual real strings of a mechanical piano.

9. The device according to claim 8, wherein the electric circuit device for controlling resonance comprises:

a microprocessor circuit;

random access memory (RAM) containing instructions to control the microprocessor;

RAM for listing in the form of tables coefficients k corresponding to sound losses in the real strings of a classical mechanical piano and coefficients $\alpha$ corresponding to energy effectively yielded by each real string, used by the microprocessor in accordance with the physical reference model; and RAM for listing in tables filtering coefficient for an output filter of the device.

10. The device according to claim 8, wherein the physical reference model comprises delay lines representing the behavior of real strings of a dynamic classical mechanical piano and includes:

a first junction in which a plurality of strings of fixed wavelength converge;

a second junction in which a plurality of strings of variable wavelength converge;

a node where the outputs of the two junctions converge and are added together and then filtered by a filter located at the output of the device;

an amplifier circuit for supplying a resonance effect to the filtered signal, which is added to an original input signal, said original input signal not having the resonance effect of a classical mechanical piano.

11. The device according to claim 10, wherein the first and second junctions contain a first set of eighteen and a second set of ten strings respectively.

12. The device according to claim 10, wherein the filter is of the low-pass type.

13. The device according to claim 10, wherein the amplifier circuit is a reference multiplier.

14. The device according to claim 10, wherein the electric circuit which embodies the physical reference model for the simulated strings of the first and the second junctions (a) effects a sum of the contributions of the simulated strings in the first junction;

(b) effects a sum of the contributions of the simulated strings in the second junction;

(c) effects an output summation of the contributions of the simulated strings in said first and second junctions;

(d) filters the output summation with a low-pass filter;

(e) amplifies the filtered output sum;

(f) adds to each of the first and second junctions an input signal without the resonance effect; and updates all the delay lines for the various simulated strings.

15. The device according to claim 10, wherein the circuit device for controlling resonance comprises:

a microprocessor circuit;

random access memory (RAM) containing instructions to control the microprocessor;

RAM for listing in the form of tables coefficients k corresponding to sound losses in the real strings of a classical mechanical piano and coefficients $\alpha$ corresponding to energy effectively yielded by each real string in the corresponding junction, used by the microprocessor in accordance with the physical reference model; and RAM for listing in tables filtering coefficients for the output filter of the device.

16. The device according to claim 15, wherein the coefficient k is the same for all the strings converging in the first junction, and is variable in accordance with the pressure exerted on the resonance pedal.

17. The device according to claim 15, wherein the value of the coefficient k relating to the strings of fixed length of the first junction is read from a corresponding table at a location determined by the position of the resonance pedal.

18. The device according to claim 15 wherein the electric circuit which embodies the physical reference model, at times when the resonance effect pedal is not in a fully pressed position, and when a note-ON message is activated, searches for a simulated string among those of the second junction;

sets the wavelength of a single delay line corresponding the found simulated string to a value conforming to the frequency of the note-ON message; and reads from the corresponding table the coefficient k as about equal to one.

19. The device according to claim 18, wherein the electric circuit which embodies the physical model, at times when the resonance pedal is fully pressed, maintains the active simulated strings of the first junction in the active state until the pedal is released;

activates free simulated strings of the first junction, when the pedal is pressed, with wavelengths corresponding to frequencies of notes in junctions subsequent to notes of the first junction; and maintains the free simulated strings activated until the pedal is released, at which time all the simulated strings are deactivated and the coefficient k of each of the simulated strings is read from the corresponding table as equal to zero.

20. The device according to claim 15, wherein the electric circuit which embodies the physical model, at times when the resonance effect pedal is not in the fully pressed position and a note-OFF message is activated, searches for a previously activated simulated string of the second junction;

frees the simulated string found; and reads from the corresponding table the coefficient k as equal to zero, in successive steps, to avoid output noise.

21. The device according to claim 20, wherein the electric circuit which embodies the physical model, at times when the resonance pedal is fully pressed, maintains the active simulated strings of the first junction in the active state until the pedal is released;

activates free simulated strings of the first junction, when the pedal is pressed, with wavelengths corresponding to frequencies of notes in junctions subsequent to notes of the first junction; and maintains the free simulated strings activated until the pedal is released, at which time all the simulated strings are deactivated and the coefficient k of each of the simulated strings is read from the corresponding table as equal to zero.

* * * * *